US005804236A

United States Patent [19]

Frisk

[11] Patent Number: 5,804,236

[45] **Date of Patent: *Sep. 8, 1998**

[54] OXYGEN SCAVENGING CONTAINER

[76] Inventor: Peter Frisk, 2300 Lincoln Park W., Chicago, Ill. 60614

[ * ] Notice: This patent issued on a continued prosecution application filed under 37 CFR 1.53(d), and is subject to the twenty year patent term provisions of 35 U.S.C. 154(a)(2).

[21] Appl. No.: 721,411

[22] Filed: Sep. 26, 1996

[51] Int. Cl.[6] ..... C01B 3/00; A23B 81/134; B65D 85/00; C08C 19/00

[52] U.S. Cl. ..... 426/106; 428/35.8; 428/215; 252/188.28; 252/181.3; 252/400.1; 525/371

[58] Field of Search ..... 428/35.8, 215; 252/188.28, 181.3, 400.1, 384; 426/106; 525/371

[56] References Cited

U.S. PATENT DOCUMENTS

| | | | |
|---|---|---|---|
| 4,536,409 | 8/1985 | Farrell et al. | 426/398 |
| 5,021,515 | 6/1991 | Cochran et al. | 525/371 |
| 5,143,763 | 9/1992 | Yamada et al. | 428/36.2 |
| 5,202,052 | 4/1993 | Zenner et al. | 252/188.28 |
| 5,211,875 | 5/1993 | Speer et al. | 252/188.28 |
| 5,239,016 | 8/1993 | Cochran et al. | 525/371 |
| 5,246,753 | 9/1993 | Koyama et al. | 428/36.7 |
| 5,310,497 | 5/1994 | Ve Speer et al. | 252/188.28 |
| 5,346,644 | 9/1994 | Speer et al. | 252/188.28 |
| 5,350,622 | 9/1994 | Speer et al. | 428/215 |
| 5,364,555 | 11/1994 | Zenner et al. | 252/188.28 |
| 5,399,289 | 3/1995 | Speer et al. | 252/188.28 |

*Primary Examiner*—Lynette F. Smith
*Attorney, Agent, or Firm*—Michael A. Catania

[57] ABSTRACT

A container composed of a polymer material integrated with an oxygen scavenging agent is disclosed that is suitable for oxygen sensitive contents. The novel container is capable of scavenging excess oxygen from the enclosed atmosphere of the container without substantially modifying the design of similar container. The container includes at least one layer composed of a polymer material integrated with an oxygen scavenging agent between 0.01 and 1.0% weight of the entire container. The oxygen scavenging layer only surrounds the atmosphere of the container while the rest of the container has an unmodified layer of the same polymer material. In most container configurations, the modified layer would be the neck portion of the container. The polymer material may be selected from polyethylene terephthalate, a copolymer of polyethylene terephthalate and a mixture thereof. The oxygen scavenging agent may be selected from iron based compounds, organic compounds and biologically active compounds. More specifically, the iron based compounds may be selected from pure iron, iron containing organic compounds, $FeO_X$, and $Fe_XO_Z(OH)_T$. The organic compounds used as oxygen scavenging agents may be selected from ascorbic acid, vitamin E, vitamin B and most other vitamins. The oxygen scavenging layer is in direct contact with the gaseous contents of the atmosphere of the container. The present invention also discloses a method for fabricating an oxygen scavenging container.

13 Claims, 4 Drawing Sheets

OXYGEN SCAVENGING CONTAINER

TECHNICAL FIELD

The present invention relates to a container composed of a polymer material integrated with an oxygen scavenger agent. Specifically, the present invention relates to a container composed of polyethylene terephthalate or a copolymer thereof, integrated with a oxygen scavenging agent in the upper portions of the container.

BACKGROUND

In the packaging industry, the permeability of containers to oxygen has been the motivating factor for a number of inventions. Excess oxygen in a container for a food product will eventually lead to the degradation of the food product. For example, excess oxygen in a wine container will lead to the oxidation of the wine which will result in the formation of acetic acid, vinegar, thereby destroying the value of the intended food product, wine. Other oxidation reactions are equally destructive to a plethora of food products which provides the motivation for those in the industry to invent different methods to overcome the problem with oxygen permeability. One method has been to prevent the ingress of oxygen into the packaging by creating packaging materials with enhanced impermeability which substantially, but not entirely, prevent the ingress of oxygen into the container. Another method has been to remove the oxygen once it has entered the container through use of an oxygen scavenger.

Various techniques have been developed to scavenge oxygen from containers using an assortment of scavenging agents. One such technique is to place the oxygen scavenging agent into one layer of the packaging material, then cover this scavenging layer with a oxygen permeable layer thereby preventing contact between the scavenging layer and the contents while allowing for the removal of oxygen from the container.

Farrell et al, U.S. Pat. No. 4,536,409, for an Oxygen Scavenger, discloses such a technique. In Farrell et al, a polymeric layer containing the oxygen scavenger agent is matched with a permeable protective layer thereby permitting removal of the oxygen without having any direct contact between the contents and the oxygen scavenging layer. Speer et al, U.S. Pat. No. 5,350,622, for a Multilayer Structure For A Package For Scavenging Oxygen also discloses a container for food which includes a barrier layer, a oxygen scavenging layer, and an innermost permeable layer which prevents contact between the contents and the oxygen scavenger. Although these inventions have the ability to scavenge oxygen from a container, they also increase the number of layers for the container to prevent contact between the scavenging agent and the contents.

Most containers for food products are not completely filled, thereby creating a space for the gaseous contents to reside when the container is sealed. Due to its partial pressure, oxygen prefers the gaseous state and will migrate from the solid or liquid phase contents to this space inadvertently created for the gaseous contents. In a bottle, this space would encompass the neck of the bottle and the space immediately below the neck. Therefore, the oxygen scavenging agent should also be located in the neck of the bottle since the majority of the excess oxygen will reside in this space.

Several inventions have come forth which attempt to take advantage of oxygen's preference for the gaseous state. Schvester, U.S. Pat. No. 4,840,280, for a Sealing Cap For Liquid Food Or Beverage Containers discloses a sealing cap for a container for a liquid contents having a sealed bag containing the scavenging agent wherein in the sealed bag is placed within the permeable layers of the cap. In this manner, Schvester attempts to scavenge oxygen from a container. Morita et al, U.S. Pat. No. 4,756,436, for a Oxygen Scavenger Container Used For Cap also discloses a cap for a container for a liquid contents which has an oxygen scavenger placed within a number of permeable layers. These caps, similar to the above-mentioned packaging materials, disclose a cap composed of a multitude of layers which increase the size and costs of the caps, and also add to the complexity of the fabrication process.

The foregoing patents, although efficacious in the scavenging of oxygen, are not the denouement of the problems of excess oxygen in containers. There are still unresolved problems which compel the enlargement of inventions in the scavenging of excess oxygen from containers.

SUMMARY OF THE INVENTION

The present invention enlarges the scope of scavenging excess oxygen from containers by providing an approach to this problem which does not increase the number of layers of a container, nor does it increase the complexity of the fabrication process. The present invention is able to accomplish this by providing a novel container composed of a polymeric material wherein only the polymeric material of the container encompassing the gaseous contents is integrated with an oxygen scavenging agent.

One embodiment of the present invention is a container capable of scavenging excess oxygen from an atmosphere of the container. The container comprises at least one layer substantially surrounding the atmosphere of the container. The at least one layer is composed of a polymer material integrated with an oxygen scavenging agent between 0.01% and 1.0% weight of the container. The polymer material may be selected from the group consisting of polyethylene terephthalate, a copolymer of polyethylene terephthalate, and a mixture thereof. The oxygen scavenging agent may be selected from the group consisting of an iron based compound, an organic compound, and a biologically active compound. The iron based compound may be selected from the group consisting of $FeO_X$, pure iron, iron containing organic compounds and $Fe_XO_Z(OH)_T$. The oxygen scavenging agent may be activated by exposure to a relatively high humidity environment. The atmosphere of the container may be composed of a gaseous contents which are predominantly water vapor, nitrogen, carbon dioxide and oxygen. The container may also be composed of a multitude of layers. The organic compound may be selected from the group consisting of ascorbic acid, vitamin B and vitamin E. Whether as a monolayer or a multilayer container, the at least one layer is in direct contact with the gaseous contents of the atmosphere of the container. In this manner the at least one layer is able to substantially prevent the degradation of the primary contents of the container. The primary contents of the container may be a flowable food product such as fruit juice or a carbonated beverage. A multilayer container may still further comprise a second layer which substantially reduces the permeability of the container to various gases.

Another embodiment of the present invention is a method for producing a container. The container is capable of scavenging excess oxygen from an atmosphere of the container. The container may be composed of at least one layer substantially surrounding the atmosphere of the container. The at least one layer may be composed of a polymer material integrated with an oxygen scavenging agent between 0.01% and 1.0% weight of the container. The polymer material may be selected from the group consisting of polyethylene terephthalate, a copolymer of polyethylene terephthalate, and a mixture thereof. The container may be produced in accordance with a method comprising the following steps: (1) integrating the oxygen scavenging agent into the polymer material matrix to form a modified polymer material; and (2) molding the modified polymer material into a configuration for substantially surrounding the atmosphere of the container. The method for producing a container may further comprise the step of embedding a non-modified polymer material with the configuration for substantially surrounding the atmosphere to complete the molding of the container.

Integration of the oxygen scavenging agent into the polymer material matrix may be accomplished by adding the oxygen scavenging agent to at least one first precursor compound for the polymer material thereby forming a modified precursor compound. The modified precursor compound is then reacted with at least one additional precursor compound for polymerization to the modified polymer material. The at least one first precursor compound should be a monomer of the polymer material. The oxygen scavenging agent may be selected from the group consisting of an iron based compound, an organic compound, and biologically active compound. The step of molding the modified polymer material into a container configuration may be selected from the group consisting of injection blow molding, extrusion blow molding and thermoforming. A preferred method of molding of the modified polymer material into a container configuration is through injection stretch blow molding. The container may be a bottle, and the configuration for substantially surrounding the atmosphere may be a neck configuration for the bottle.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE DRAWINGS

Several features of the present invention are further described in connection with the accompanying drawings in which:

There is illustrated in FIG. 1 a cross-section view of one embodiment of a container of the present invention.

Figure 2:
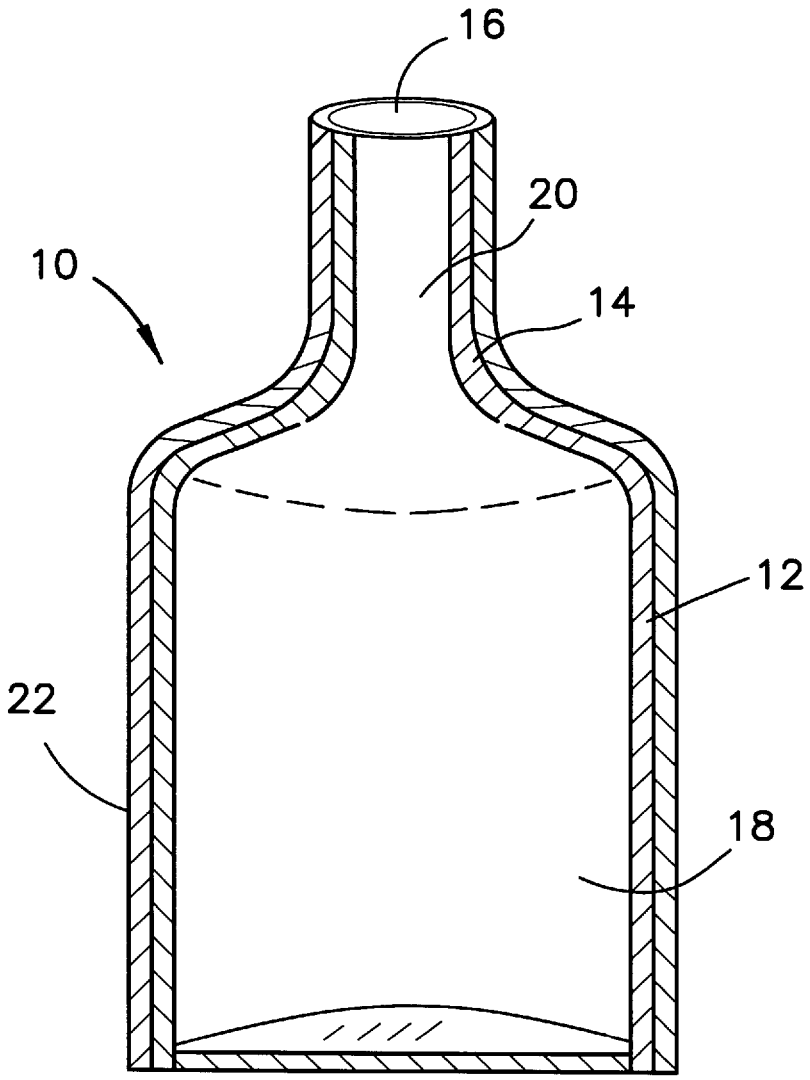

There is illustrated in FIG. 2 a cross-section view of an alternative embodiment of a container of the present invention.

Figure 3:
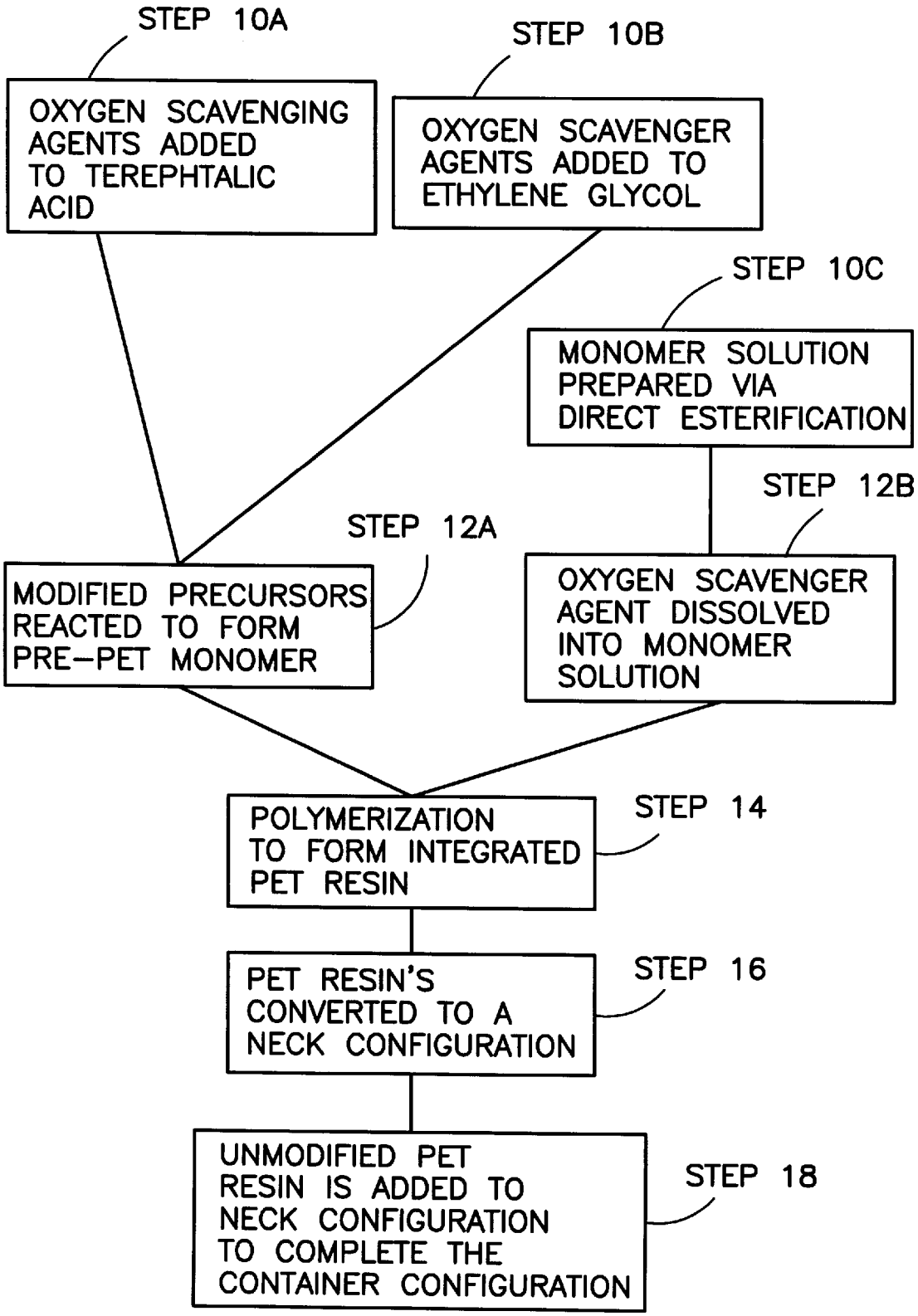

There is illustrated in FIG. 3 a flow diagram for a process for fabricating one embodiment of the present invention.

Figure 4:
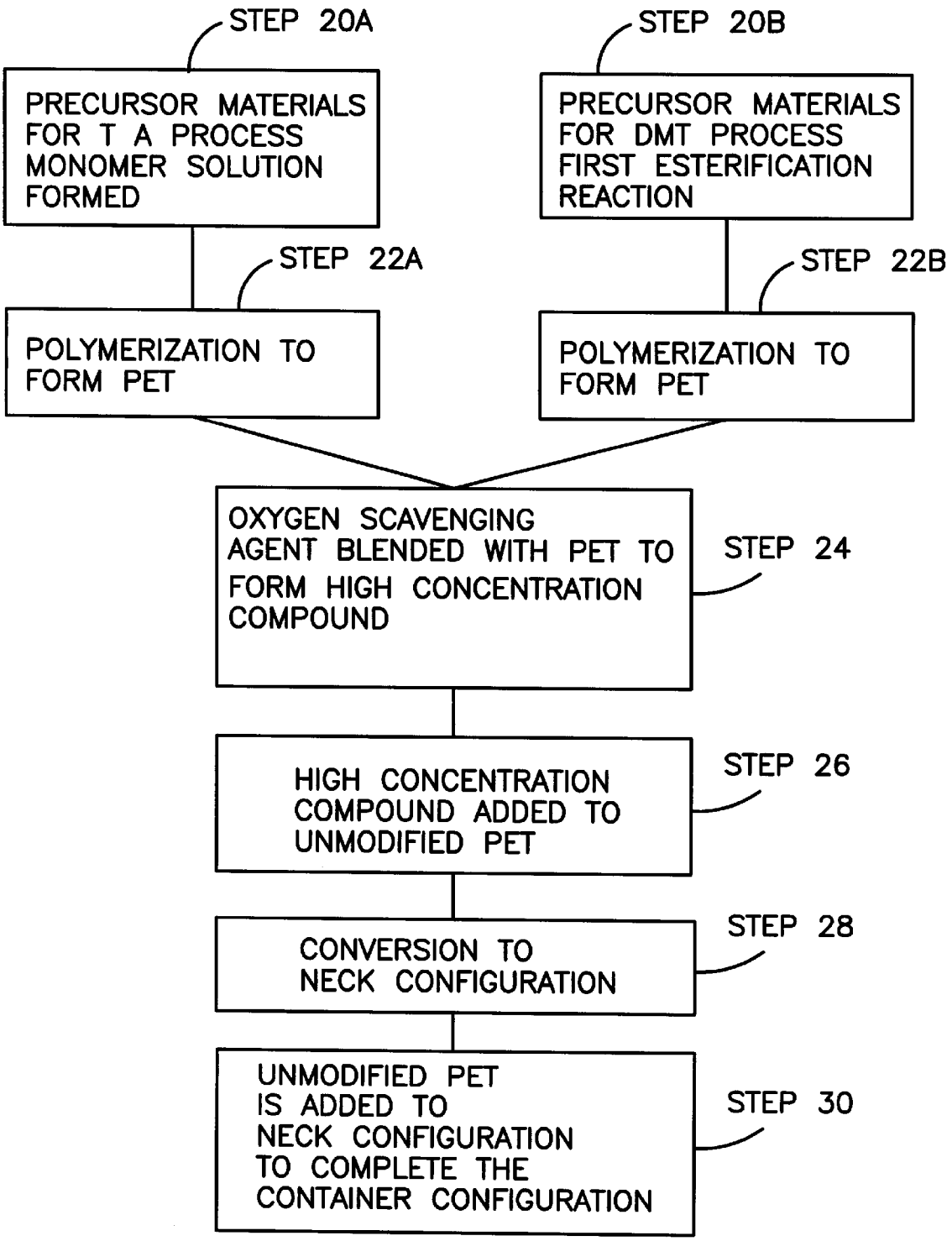

There is illustrated in FIG. 4 a flow diagram for an alternative process for fabricating one embodiment of the present invention.

DETAILED DESCRIPTION OF THE PREFERRED EMBODIMENTS

Containers for flowable food products such as fruit juices, alcoholic beverages, soups and the like usually provide for an "atmosphere" in the sealed container. This atmosphere, which is composed of gaseous contents, usually lies above the primary contents of the container and serves several purposes. One purpose may be to reduce the amount of the primary contents of the container as a costs saving measure to the manufacturer. Another purpose may be to serve as a safety measure to accommodate variations in pressure the container may undergo during distribution. Still another purpose may be to provide the consumer with a container which will not spill its contents during the opening of the container. Although this atmosphere may serve many purposes, it may also present problems for the manufacturers. One such problem pertains to excess oxygen in the container. Excess in that the oxygen is not needed by the contents of the container and in fact is most likely detrimental to the contents of the contain. The container of the present invention is designed to remove the excess oxygen from the atmosphere of the container in a novel manner which does not greatly increase the costs or complexity of fabricating containers for flowable food products.

The container of the present invention is composed of a modified polymeric material which is capable of scavenging excess oxygen from the atmosphere of the container. The modified polymeric material is PET, COPET or a mixture thereof integrated with an oxygen scavenging agent. The oxygen scavenging agent is integrated with PET, COPET or a mixture thereof before the modified polymeric material is converted into a container configuration such as a bottle. One of the novel aspects of the present invention is the minimal amount of an oxygen scavenging agent necessary to effectively remove excess oxygen from the atmosphere of the container. The present invention only requires a minimal amount of oxygen scavenging agent since only the upper portion of the container which surrounds the atmosphere is actually composed of the modified polymeric material while the rest of the container is composed of an unmodified polymeric material. This upper portion of the container, sometimes referred to as the "headspace," is where oxygen prefers to reside in the container due to the partial pressure of oxygen. Therefore, by taking advantage of oxygen's preference for the gaseous state, the present invention only requires a minimal amount of oxygen scavenging agent to effectively prevent the oxidation of the primary contents of the container.

The oxygen scavenging agent is integrated with the polymeric material in an amount of approximately 0.01 to 1.0 weight percent of the entire container. The oxygen scavenging material may be selected from one or more materials including: an organic compound; an iron-based compound; and/or a biologically active compound. The iron-based compound may include $FeO_x$, pure iron, an iron containing organic compound and $Fe_xO_y(OH)_z$. The use of iron-based compounds allow the oxygen scavenging agent to be humidity activated at a time prior to or concurrent with the filling of the container. For example, subsequent to the fabrication of the container, the container may be stored indefinitely in a relatively low humidity environment. Then, prior to or concurrent with the filling process, the container may be exposed to a relatively high humidity environment for a predetermined time period sufficient for the activation of the oxygen scavenging agent. A further, iron based oxygen scavenging compound suitable for use in the present invention is OXYGUARD which is available from Toyo Seikan Kaisha of Yokahama, Japan.

Various organic compounds which are well known by those skilled in the pertinent art may be utilized as oxygen scavenging agents for the present invention. For example, ground sea grass and/or ground tea leaves may be suitable for use as an oxygen scavenging agent for the present invention. Also, a rice extract, such as disclosed in Tokuyama et al, U.S. Pat. No. 5,346,697, for an Active Oxygen Scavenger, may be utilized as an oxygen scavenging agent for the present invention. Further, most vitamins may be used as oxygen scavenging agents in practicing the present invention. Specifically, an ascorbic acid (vitamin C), a vitamin B or a vitamin E compound may be used as oxygen scavenging agents in practicing the present invention.

Monomers and short chain polymers of, for example, polypropylene and/or polyethylene are likewise organic compounds which are suitable as oxygen scavenging agents for utilization in practicing the present invention. If a short chain polymer is utilized, selective activation of the oxygen scavenger agent is possible by irradiating the modified polymeric material with, for example, ultraviolet light or with electron beam emissions. Such irradiation effects a cutting of the inter-monomer bonds thereby creating even shorted, and more chemically active, polymer chains and monomers. If acceleration of the oxygen scavenging process is desirable, a mixture of both organic compounds and iron-based compounds may be integrated into the polymeric material which in a preferred embodiment is either PET, COPET or a mixture thereof.

PET may be prepared from either of two general processes: (1) the dimethyl terephthalate ("DMT") process and (2) the terephthalic acid ("TA") process. The preparation of PET by the DMT process proceeds through two successive ester interchange reactions. In an ester interchange reaction, the alcohol residue of an ester is replaced by another alcohol residue by treating the ester with alcohol. In the first ester interchange reaction, dimethyl terephthalate (a dicarboxylic acid) is heated with an excess of ethylene glycol (a dihydroxy compound) at 150°–210° C. in the presence of a catalyst (the molar ratio is 1:2.1–2.2). The ester interchange occurs as follows with the principal product being bis(2-hydroxyethyl) terephthalate:

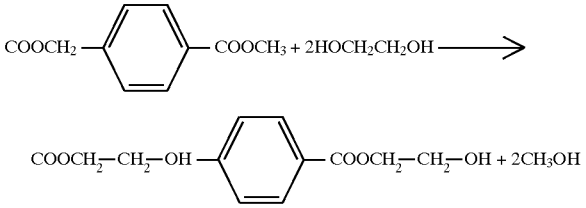

In the second ester interchange, after the methanol is distilled off, the bis(2-hydroxyethyl) terephthalate serves as both the ester and the alcohol for the reaction. The bis(2-hydroxyethyl) terephthalate is heated at 270°–285° C. with continuous evacuation to pressures below 1 mm Hg. Successive interchanges result in the formation of the polyester, PET, which is polymerized until an average molecular weight of about 20,000 is reached and then the molten polymer is extruded from the reactor and disintegrated. The PET has the general formula:

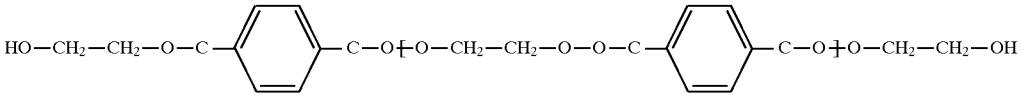

The preparation of PET by the TA process proceeds through a direct esterification reaction. The terephthalic acid (a dicarboxylic acid) is reacted with ethylene glycol (a dihydroxy compound) in a molar ratio of 1 to 1.5, at a pressure range of approximately 5 psia to 85 psia, and at a temperature range of approximately 185° to 290° C. for approximately 1 to 5 hours. The products formed are the monomer and water which is removed as the reaction proceeds. Next, the polymerization of the monomer occurs at a pressure range of 0 to 40 mm Hg at a temperature range of about 205° to 305° C. for approximately 1 to 4 hours which results in the formation of the PET resin.

PET and COPET are made by dicarboxylic acid compounds and dihydroxy compounds. As described above, PET is the product of a reaction between terephthalic acid and ethylene glycol. COPET is the product of a reaction of a substitution of either the terephthalic acid or dimethyl terephthalate (the dicarboxylic acid compound), and ethylene glycol (the dihydroxy compound) which may also be substituted for by another dihydroxy compound. The substitution may be either a partial or a full substitution of either of the compounds. The possible substitutes for the dicarboxylic acid compound include the following: isophthalic acid; adipic acid; sebacic acid; azelaic acid; decanedicarboxylic acid; naphthalenedicarboxylic acid; diphenyldicarboxylic acid; and diphenoxyethanedicarboxylic acid. The possible substitutes for the dihydroxy compound include the following: diethylene glycol; triethylene glycol; trimethylene glycol; tetramethylene glycol; hexamethylene glycol; propylene glycol; neopentyl glycol; 1,3 bis (2 hydroxyethoxy) benzene; 1,4 bis (2 hydroxyethoxy) benzene; bis(2-hydroxyethyl) dimethylmethane; bis(4-beta-hydroxyethoxyphenyl)sulfone; cyclohexanedimethanol; cyclohexanediethanol; and cyclohexanedipropanol. The reactions for producing the COPET is similar to the reactions for forming the PET. The reactions may also be used to produce a blend of PET and COPET. When referring to a mixture of PET and COPET, the mixture may be a blend of PET and COPET, or PET and COPET produced through separate reactions then admixed to form the mixture.

Once the modified polymer material is formed, the oxygen scavenging container may be fabricated through a number of molding methods. Although the novel oxygen scavenging container of the present invention has the capability to remove excess oxygen from the gaseous contents of the container, the novel container may be fabricated in a similar fashion to containers fabricated from unmodified PET or COPET resin with only minor adjustments to the molding processes.

Three methods for manufacturing containers from PET or COPET resin are extrusion molding, injection molding and thermoforming. One extrusion method is extrusion blow molding wherein the parison is extruded and blow molded to the final bottle configuration. Another method is extrusion stretch blow molding wherein the parison is extruded and cooled to a wall temperature range of approximately 90°–125° C., then blow molded to the final bottle configuration. Still another method is two stage extrusion stretch blow molding wherein the parison is first extruded and cooled to room temperature. Then, the parison is transported to a separate operation where it is reheated to a wall temperature of 90°–125° C. and then blow molded to the final bottle configuration.

An injection method is injection blow molding wherein a parison is injected molded and then the hot parison is blow molded to the final container configuration. Yet another injection method is injection stretch blow molding wherein a parison is injection molded and cooled to a wall temperature of 90°–125° C. before being stretch blow molded to the final container configuration. A final method is two stage injection stretch blow molding wherein a parison is injection molded and cooled to room temperature. Then, transported to a separate operation where it is reheated to a wall temperature of 90°–125° C. and then stretch blow molded to the final container configuration.

Thermoforming is a low pressure process that converts flat, basically two-dimensional thermoplastic sheet stock into larger, generally more complex three dimensional containers. The thermoforming process begins with sheets that are cut to size, then loaded and clamped into a thermoforming machine. The sheet is heated to a softening temperature and formed into a container. The containers are cooled, unloaded from the machine and trimmed to remove any extra material.

A preferred method of fabricating the oxygen scavenging container is through two-stage injection stretch blow molding, however any of the previously mentioned molding processes will suffice to fabricated an oxygen scavenging container embodied in the present invention.

Figure 1:
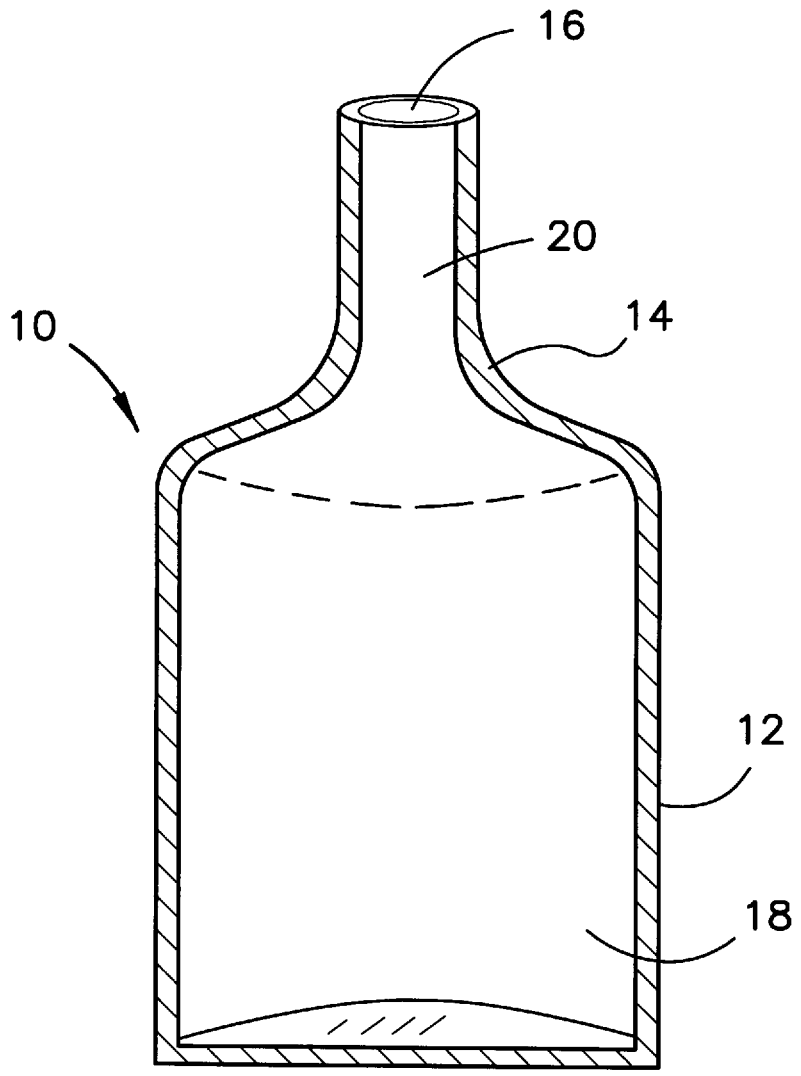

There is illustrated in FIG. 1 a cross-section side view of one embodiment of a container of the present invention. There is illustrated in FIG. 2 a cross-section side view of an alternative embodiment of a container of the present invention. As shown in FIGS. 1 and 2, a container is generally designated 10. Although the container 10 is in the shape of a bottle, such shape is for illustration purposes and is not intended to limit the possible configurations for the present invention. The container 10 consists of a lower portion 12 and an upper portion 14. The container 10 also has an opening 16 located at the top of the container 10.

The lower portion 12 generally encompasses the area filled by a primary contents 18 of the container 10. The primary contents 18 may be a liquid such as a carbonated beverage, water, fruit juice and the like. The primary contents 18 may also be a solid such as a granular spice. Further, the primary contents may be a combination of a liquid and a solid such as a soup or yogurt. The lower portion 12 is composed of a polymer material which is substantially unreactive with the primary contents 18 of the container 10. In a preferred embodiment, the lower portion 12 is composed of PET, COPET or some mixture thereof. However, alternative embodiments may have a modified PET, COPET or mixture thereof which enhances the inherent properties of such materials.

The upper portion 14 generally encompasses a gaseous contents 20 of the container 10. In the bottle configuration illustrated in FIG. 1, the upper portion 14 is the neck portion of the bottle. The gaseous contents 20 will most likely be gases entrapped in the container 10 after sealing of the opening 16 and gases permeating from the primary contents 18. The gaseous contents 20 may also be gases which permeated through the container 10 from either the lower portion 12 or the upper portion 14. The gaseous contents 20 will predominantly include oxygen, carbon dioxide and water vapor. The upper portion 14 is composed of a modified polymer material which is capable of a scavenging oxygen from the gaseous contents 20 thereby reducing the possibility that the oxygen will adversely react with the primary contents 18. The modified polymer material has an integrated oxygen scavenging agent which binds with any excess oxygen thereby removing it from the gaseous contents 20. The polymer material is PET, COPET or any mixture thereof, and the oxygen scavenging agent is integrated into the polymer material as described below.

In a preferred embodiment, the upper portion 14 is composed of one layer of the modified polymer material which is in direct physical contact with gaseous contents 20. However, alternative embodiments may have a multitude of layers, and may have a layer which is an oxygen barrier layer juxtaposed between the modified polymer material and the exterior of the container. The upper portion 14 is located above the primary contents 18 to minimize the contact between the primary contents 18 and the oxygen scavenging agent integrated into the polymer material of the upper portion 14. Thus, the size of the upper portion 14 and lower portion 12 will be dependent on the size and shape of the container 10, and the level to which the primary contents 18 is filled within the container 10.

As mentioned previously, the container 10 may have a multitude of layers in addition to the layer of modified polymer material and unmodified polymer material. These additional layers may have enhanced barrier properties to prevent the ingress and egress of various gases including oxygen. As shown in FIG. 2, an additional exterior layer 22 surrounds the layer which is upper portion 14 and lower portion 12. The additional layer There is illustrated in FIG. 3 a flow diagram for a process for one embodiment of the present invention. As shown in FIG. 3, this first method of integration occurs before and during polymerization of the polymeric material. Although the process described in FIG. 3 is directed toward PET as the polymer material, those skilled in the pertinent art will recognize that the process may easily be adapted for the integration of other polymer materials, especially COPET. At step 10A and step 10B, the oxygen scavenger agents are added to the precursors materials (terephthalic acid and ethylene glycol) before the polymerization process to form a modified precursor material. Preferably, the oxygen scavenger agents should not affect the transparency of the PET. At step 12A, the modified precursor materials are reacted to form the modified pre-PET monomer. Using the TA process, step 12A is a direct esterification reaction.

An alternative pathway to obtain the modified pre-PET monomer occurs through step 10C where the monomer solution is prepared through a direct esterification reaction using non-modified precursor materials. Then at step 12B, the oxygen scavenger agent is dissolved into the monomer solution, before the polymerization process, to form the modified pre-PET monomer. At step 14, the modified pre-PET monomer is polymerized to form the integrated PET resin. At step 16, the integrated PET resin is converted to a neck configuration for a container. At step 18, unmodified PET resin is added to the neck configuration to complete the final container configuration. Although this example pertains to a neck configuration for a bottle, those skilled in the pertinent art will recognize that other configurations to encompass the gaseous contents of a container are applicable to other container shapes. The molding of the container may take place through many processes, including the above-mentioned molding processes.

There is illustrated in FIG. 4 a flow diagram of an alternative embodiment of the process for the present invention. As shown in FIG. 4, the second method of integration occurs before or during the conversion of the PET resin into the final package design. Although the process described in FIG. 4 is directed toward PET as the polymer material, those skilled in the pertinent art will recognize that the process may easily be adapted for the integration of other polymer materials, especially COPET. The second method of integration may begin through two different pathways. In step 20A, the precursor materials for the TA process are reacted to form the monomer solution. In step 20B, the precursor materials for the DMT process undergo the first esterification reaction. In steps 22A and 22B, polymerization occurs to form a PET resin. In step 24, the oxygen scavenger agent is blended into the PET resin which results in a PET compound with a high concentration of the oxygen scavenger agent. The blending of the oxygen scavenger agent may be performed through use of a twin screw extruder. In step 26, a small amount of unmodified PET In step 26, this high concentration compound is then added to a larger amount of unmodified PET resin before conversion to the final package. In step 28, the PET resin, including the high concentration compound, is converted to the neck configuration. The conversion of the PET resin to the neck configuration also assists in blending and dispersing the high concentration compound throughout the PET resin, and ultimately the neck of the bottle. At step 30, unmodified PET resin is added to the neck configuration to complete the final container configuration. Although this example pertains to a neck configuration for a bottle, those skilled in the pertinent art will recognize that other configurations to encompass the gaseous contents of a container are applicable to other container shapes. The molding of the container may take place through many processes, including the above-mentioned molding processes.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A bottle for containing a liquid food product, the bottle having an interior layer, the bottle capable of scavenging excess oxygen from an atmosphere formed within the sealed bottle, the interior layer of the bottle in direct contact with the liquid food product and the atmosphere of the sealed bottle, the bottle comprising:

an upper portion of the interior layer of the bottle, the upper portion surrounding the atmosphere of the bottle, the upper portion of the interior layer consisting of polyethylene terephthalate integrated with an oxygen scavenging agent, the oxygen scavenging agent being present in an amount between 0.01% and 1.0% of the weight of the bottle, the upper portion of the interior layer in direct contact with the atmosphere of the bottle; and a lower portion of the interior layer of the bottle, the lower portion contiguous with the upper portion, the lower portion surrounding the liquid food product, the lower portion consisting of polyethylene terphthalate;

whereby the oxygen scavenging agent is only present in the upper portion of the bottle and the oxygen scavenger degrades oxygen present in the atmosphere of the bottle without substantially contacting the liquid food product.

2. The bottle according to claim 1 wherein the oxygen scavenging agent is selected from the group of iron, iron oxides, and iron containing organic compounds.

3. The bottle according to claim 1 wherein the oxygen scavenging agent is selected from the group of ascorbic acid, vitamin E and vitamin B.

4. The bottle according to claim 1 wherein the oxygen scavenging agent is either polypropylene or polyethylene whereby the oxygen scavenging agent is activated by subjecting the bottle to irradiation by ultraviolet light or an electron beam.

5. The bottle according to claim 1 further comprising a second layer, the second layer disposed on an exterior surface of the interior layer of the bottle, the exterior surface opposite the interior of the bottle.

6. A bottle for containing a liquid food product, the bottle having an interior layer, the bottle capable of scavenging excess oxygen from an atmosphere formed within the sealed bottle, the bottle composed of a neck portion of the interior layer surrounding the atmosphere of the bottle and a lower portion of the interior layer contiguous with the neck portion, the lower portion surrounding the liquid food product, the bottle produced in accordance with a method comprising the following steps:

molding a modified polyethylene terephthalate film integrated with an oxygen scavenging agent into a neck portion of the bottle, the oxygen scavenging agent being present in an amount between 0.01% and 1.0% of the weight of the bottle; and embedding a non-modified polyethylene terephthalate film with the neck portion to form the lower portion of the bottle;

whereby the oxygen scavenging agent is only present in the upper portion of the bottle and the oxygen scavenger does not substantially contact the liquid food product.

7. The bottle according to claim 6 wherein the oxygen scavenging agent is selected from the group of iron, iron oxides, and iron containing organic compounds.

8. The bottle according to claim 6 wherein the oxygen scavenging agent is selected from the group of ascorbic acid, vitamin E and vitamin B.

9. The bottle according to claim 6 wherein the oxygen scavenging agent is either polypropylene or polyethylene whereby the oxygen scavenging agent is activated by subjecting the bottle to irradiation by ultraviolet light or an electron beam.

10. A bottle for containing a liquid food product, the bottle having an interior layer, the bottle capable of scavenging excess oxygen from an atmosphere formed within the closed and sealed bottle, the atmosphere containing a gaseous contents including oxygen, the bottle consisting essentially of:

an neck portion of the interior layer surrounding the atmosphere of the bottle, the neck portion consisting of polyethylene terephthalate integrated with an oxygen scavenging agent, the oxygen scavenging agent being present in an amount between 0.01% and 1.0% of the weight of the bottle; and a lower portion of the interior layer contiguous with the neck portion, the lower portion surrounding the liquid food product, the lower portion consisting of polyethylene terephthalate;

whereby the oxygen scavenging agent is only present in the neck portion of the bottle and the oxygen scavenger degrades oxygen present in the atmosphere of the bottle without substantially contacting the liquid food product.

11. The bottle according to claim 10 wherein the oxygen scavenging agent is selected from the group of iron, iron oxides, and iron containing organic compounds.

12. The bottle according to claim 10 wherein the oxygen scavenging agent is selected from the group of ascorbic acid, vitamin E and vitamin B.

13. The bottle according to claim 10 wherein the oxygen scavenging agent is either polypropylene or polyethylene whereby the oxygen scavenging agent is activated by subjecting the bottle to irradiation by ultraviolet light or an electron beam.

* * * * *